United States Patent [19]

Patel

[11] Patent Number: 4,886,117

[45] Date of Patent: Dec. 12, 1989

[54] INFLATABLE WELL PACKERS

[75] Inventor: Dinesh R. Patel, Sugar Land, Tex.

[73] Assignee: Schlumberger Technology Corporation, Houston, Tex.

[21] Appl. No.: 267,744

[22] Filed: Nov. 2, 1988

Related U.S. Application Data

[63] Continuation of Ser. No. 922,628, Oct. 24, 1986, abandoned.

[51] Int. Cl.[4] ..... E21B 33/127

[52] U.S. Cl. ..... 166/187; 277/34; 277/34.6

[58] Field of Search ..... 166/187; 277/34.6, 34, 277/34.3, 30, 230

[56] References Cited

U.S. PATENT DOCUMENTS

| | | | |
|---|---|---|---|
| 2,342,884 | 2/1944 | Moore | 277/34.6 |
| 2,643,722 | 6/1953 | Lymes et al. | 166/187 |
| 2,778,432 | 1/1957 | Allen | 277/34 |
| 2,827,965 | 3/1958 | Mounce | 277/34.6 |
| 3,104,717 | 9/1963 | Sandlin et al. | 166/187 |
| 3,604,732 | 9/1971 | Malone | 277/34 X |
| 4,253,676 | 3/1981 | Baker et al. | 166/187 X |
| 4,406,461 | 9/1983 | McGill | 277/34.6 |
| 4,424,861 | 1/1984 | Carter, Jr. et al. | 166/187 X |
| 4,544,165 | 10/1985 | Coone | 277/34 |
| 4,614,346 | 9/1986 | Ito | 166/187 X |

FOREIGN PATENT DOCUMENTS

| | | | |
|---|---|---|---|
| 1177762 | 11/1984 | Canada . | |
| 205367 | 12/1986 | European Pat. Off. | 166/187 |
| 2517017 | 5/1983 | France . | |
| 2582077 | 11/1986 | France . | |
| 440481 | 1/1975 | U.S.S.R. | 166/187 |

*Primary Examiner*—Hoang C. Dang

*Attorney, Agent, or Firm*—Henry N. Garrana; John H. Bouchard

[57] ABSTRACT

An inflatable well bore packer element, having inner and outer elastomer plies and an intermediate sheath of reinforcing wires, is secured at each end to a central mandrel by inner and outer annular coupling members. Wedge-shaped gripping members that hold the free ends of the reinforcing wires between facing surfaces of the coupling members are positioned and secured by independently tightened rings. The inner elastomer ply is bonded to the inside of the inner coupling member, and the tip of the inner coupling member is formed with a deformable skirt portion that flexes during packer inflation to oppose extrusion of the inner ply into the reinforcing wire holding area between the facing surfaces. The tip of the outer coupling member is rounded to protect the outer elastomer ply from tearing.

7 Claims, 2 Drawing Sheets

INFLATABLE WELL PACKERS

This is a continuation of Ser. No. 922,628 filed Oct. 24, 1986, now abandoned.

BACKGROUND OF THE INVENTION

This invention relates to inflatable well bore packers. More particularly, this invention relates to new and improved inflatable packers employing elastomeric packer elements that are reinforced by alternately biased plies of reinforcing wires and mounted on a packer mandrel by special end fittings cooperatively securing the end portions of the wires

BACKGROUND ART

Inflatable packers are frequently used for selectively isolating formation intervals during the performance of various testing or completion operations in cased well bores, as well as in uncased boreholes. Since inflatable packers are actuated by fluid pressure instead of by selective movements of their supporting pipe string, it is often preferred to utilize such packers both as a single packer as well as for the spaced packers on a so-called "straddle testing" tool. It is, however, recognized that inflatable packer elements are apt to fail under extreme pressure differentials unless particular care is taken in their design and construction. Many of the problems encountered with prior art inflatable packers have been overcome with packers such as, for example, the packers disclosed in U.S. Pat. No. 4,406,461 and Canadian Pat. No. 1,177,762. Nevertheless, no completely satisfactory solution has heretofore been provided for securing an inflatable reinforced packer element to a packer mandrel so that the tool can be reliably operated under extreme pressure differentials.

OBJECTS OF THE INVENTION

Accordingly, it is an object of the present invention to provide new and improved inflatable packers having internally-reinforced packer elements which have their end portions firmly secured to the mandrels of the packers and reliably supported against failure under extreme well bore pressures.

It is a further object of the present invention to provide a well bore packer having an inflatable packer element with a plurality of reinforcing strands bonded between inner and outer elastomeric plies, with the element being mounted on the packer mandrel between new and improved coupling assemblies with gripping means securing the ends of the reinforcing strands as well as deformable support means which cooperatively expand or move outwardly as the packer element is initially inflated to support the end portions of the inner ply against rupture.

SUMMARY OF THE INVENTION

These and other objects of the present invention are attained by providing a new and improved well bore packer having an inflatable packer element that is comprised of inner and outer elastomeric plies coaxially arranged on and bonded to an intermediate sleeve formed of multiple plies of reinforcing strands. To secure the packer element to the packer mandrel, inner and outer coupling members are coaxially disposed around the mandrel at each end of the packer element so as to define convergent annular spaces into which the free ends of the strands are disposed and cooperatively secured. The outer coupling members have end portions extending over the packer element and bonded to the ends of the outer elastomeric ply and which are internally rounded to accommodate the outward movement of the reinforcing strands over the rounded end portions as the element is inflated. The inner coupling members include yieldable or deformable skirt portions disposed over the ends of the inner elastomeric ply and bonded thereto so that the pressure forces inflating the packer element will correspondingly expand these deformable skirt portions outwardly to support the end portions of the inner ply.

In one embodiment of the invention, the reinforcing strands are secured by driving coaxially-arranged inner and outer gripping members between the end portions of the strands in the annular spaces. In an alternative embodiment, single gripping members are driven between the strands in the annular spaces and secured by inner and outer threaded locking rings. The threaded rings are cooperatively arranged so that tightening of one ring will move the gripping member inwardly for securely clamping some of the strands against one coupling member and tightening of the other locking ring will pull the other coupling member outwardly against the gripping member for securely clamping the remaining reinforcing strands against the other coupling member

BRIEF DESCRIPTION OF THE DRAWINGS

The novel features of the present invention are set forth with particularity in the appended claims. The invention, together with further objects and advantages thereof, may best be understood by way of illustration of the following description of exemplary apparatus employing the principles of the present invention as illustrated in the accompanying drawing, in which:

DESCRIPTION OF A PREFERRED EMBODIMENT

Figure 1:
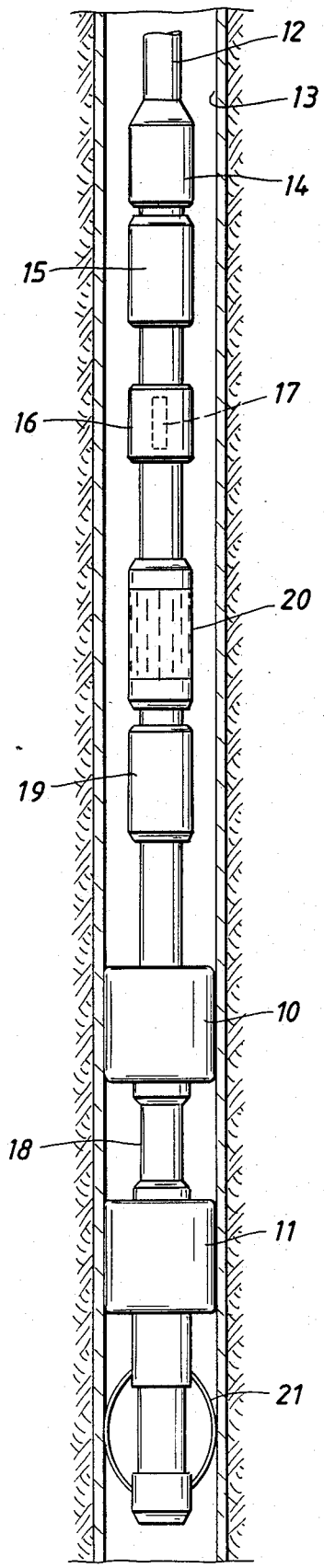
FIG. 1 shows a typical assembly of well tools in a well bore including a typical straddle-packer tester employing a preferred embodiment of a new and improved inflatable packer of the present invention.

Turning now to FIG. 1, new and improved inflatable well bore packers 10 and 11 incorporating the principles of the present invention are depicted in a typical string of well tools dependently suspended from a pipe string 12 at a selected depth in a well bore 13 where the packers have been expanded into sealing engagement with the adjacent walls of the well bore. Although the new and improved packers 10 and 11 can be employed either independently or together as well as with various types of well bore tools, to illustrate one manner for utilizing these packers, the tools are depicted as including a circulating valve 14 and a tester valve 15 which are respectively actuated by selectively varying the pressure of the fluids in the annulus of the well bore 13 above the packers 10 and 11. A recorder housing 16 carrying one or more pressure recorders 17 is dependently coupled to the tester 15. A central mandrel 18 intercoupling the packers 10 and 11 communicates the tester valve 15 with the well bore interval between the straddle packers 10 and 11. Although the inflatable packers 10 and 11 could just as well be expanded by pumping fluids from the surface through the pipe string 12, the tools depicted in FIG. 1 preferably include a rotary pump 19 which is operable by rotating the pipe string for drawing well bore fluids through a screened inlet pipe 20 and pumping them into the packers to inflate them. A typical drag spring anchor 21 is coupled in the tool string to keep the tools from turning as the pipe string 12 is rotated to drive the pump 19.

Figure 2:
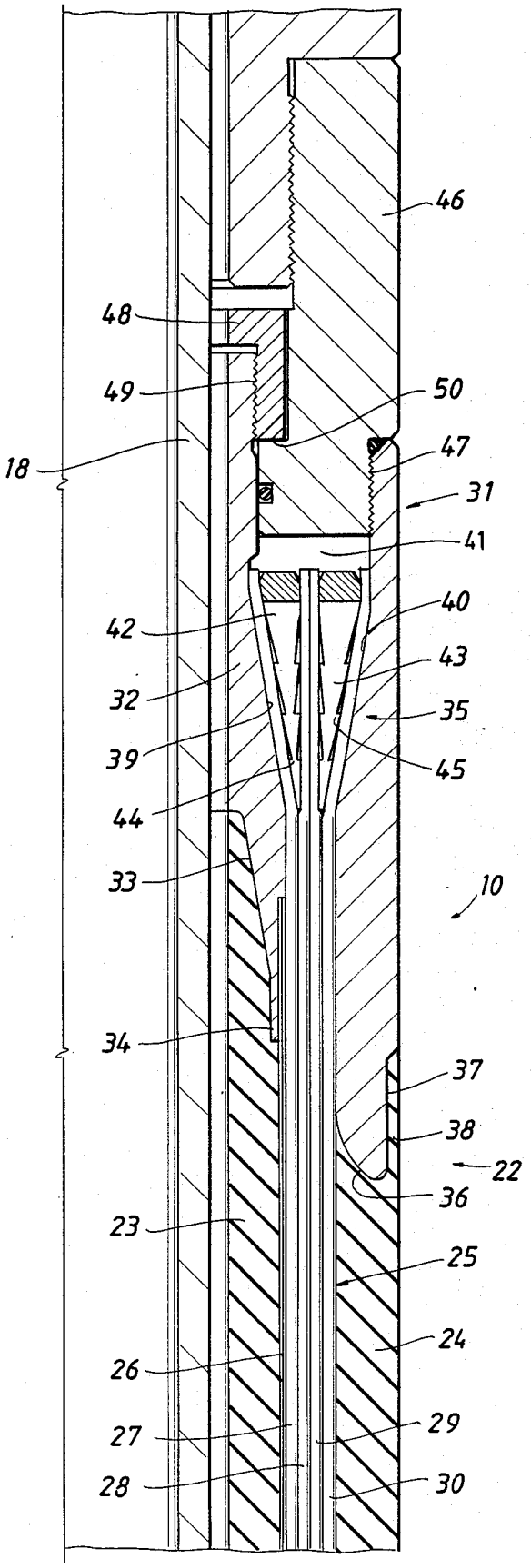
FIG. 2 is an enlarged cross-sectioned view of part of one of the packers shown in FIG. 1 showing a new and improved coupling assembly incorporating the principles of the present invention to cooperatively secure an inflatable reinforced packer element to the packer mandrel.

Since the upper and lower end portions of the new and improved inflatable packers 10 and 11 are identical, FIG. 2 depicts only an enlarged, cross-sectioned partial view of the upper end portion of the packer to illustrate the principles of the present invention. To fabricate the illustrated packer element 22, inner and outer elastomeric sleeves 23 and 24 are respectively disposed inside of and around an intermediate reinforcing sleeve, as shown generally at 25, comprised of multiple plies of stranded steel wires; and these three sleeves are bonded together in a typical fashion such as by vulcanization to provide a unitary reinforced packer element capable of being inflated from its normal relaxed diameter to a predetermined expanded diameter. In the preferred embodiment of the inflatable packer element shown generally at 22, the inner sleeve or ply 23 is preferably compounded from an easily expandable elastomer and the outer sleeve or ply 24 is preferably formed of a tough elastomer selected to form a protective outer covering able to withstand abrasive well bore walls.

As one example of a preferred embodiment of the packer element 22, the inner elastomeric ply 23 is enclosed by a sheath 26 formed of two or more layers or plies of stranded steel wires or cords which are laid close to one another, with the wires in each ply being successively directed in an alternate helical direction, so as to oppose outward extrusion of the packer element 22 through the layers of the intermediate reinforcing sleeve 25 during packer inflation. In the depicted exemplary packer element 22, the protective sheath 26 is comprised of first and second plies of stranded steel wires having a diameter of about 0.03 inch laid at an angle of about 12 degrees in relation to the longitudinal axis of the packer mandrel 18, with one ply extending in a right-hand helix and the other in a left-hand helix. In fabricating the protective sheath 26, to ensure that the sheath will have uniform thickness the stranded wires in these two inner plies may, for example, be dipped in a suitable bonding agent and calendared with rubber before being wrapped around and secured over the inner elastomeric ply 23 of the new and improved inflatable packer element 22.

The design parameters for the reinforcing sleeve 25 are governed by the maximum expected differential pressure to be imposed on the element 22 as well as the maximum expanded diameter of the packer element. Since the inner sheath 26 has only a limited strength, the principal strength of the packer element 22 is provided by the reinforcing sleeve 25 which is formed of two or more plies, as at 27–30, of closely-spaced stranded wires or cables which, in the depicted exemplary packer element, are about 0.125 inch in diameter and are cooperatively arranged between the outer elastomeric ply 24 and the protective sheath 26. The several plies 27–30 are, preferably, respectively laid in pairs in alternate right-hand and left-hand directions at bias angles which successively increase from about 14 degrees for the innermost ply to about 16 degrees for the outermost ply. This progressive angling provides for even distribution of the load across all the plies at expansion. The protective sheath 26, the several reinforcing plies 27–30 and the elastomeric plies 23 and 24 are vulcanized together in a suitable fashion to form a substantially unitary packer element 22 with the free ends of the stranded wires of the several reinforcing plies 27–30 extending beyond the opposite ends of the packer element.

To prepare the packer element 22 for mounting on the mandrel 18, an end-coupling assembly, as seen generally at 31, is coaxially fitted over and secured to each end of the inflatable packer element 22. As shown in FIG. 2, each end-coupling assembly 31 includes an annular inner coupling member or ring 32 which has been counterbored to define a frustoconical socket 33 into which the complementary-shaped end of the inner elastomeric sleeve 23 is snugly fitted and secured by a typical bonding technique. As will subsequently be discussed in detail, a major feature of the present invention is that the outer end of the socket 33 is cooperatively enlarged or counterbored to define a thin-walled skirt portion 34 around the entrance to this socket. In keeping with the objects of the invention, by designing the skirt portion 34 to expand as the pressure forces imposed thereon by inflation of the packer element increase, the adjacent end portion of the inner elastomeric ply 23 will be supported against extrusion around the inner coupling member 32 when the packer 10 is set. As illustrated, the external surface of the inner member 32 is also reduced slightly and the exposed ends of the reinforcing sheath 26 are fitted over the entrance to the socket 33 and suitably bonded around the deformable skirt portion 34.

Each end-coupling assembly 31 also includes an annular outer coupling member or ring, as at 35, which is coaxially disposed around the adjacent end of the expandable packer element 22; with the axial bore of each outer coupling member being cooperatively sized to snugly receive the exposed end portions of the main reinforcing plies 27–30. The inwardly-projecting end of each outer coupling member 35 adjacent to the outer elastomeric ply or sleeve 24 is shaped to provide a rounded, outwardly-diverging entrance 36 receiving the exposed end portions of the reinforcing plies 27–30 and adapted to support the plies upon expansion of the packer element 22. It is also preferred to externally reduce the inner end portion of the outer coupling members 35 for a short distance to provide reduced portions 37 that may be snugly fitted into and bonded to a tubular extension 38 of the outer elastomeric sleeve or ply 24.

Those skilled in the art will recognize that as the packer element 22 is inflated, the resulting circumferential enlargement of the several reinforcing plies 27–30 will subject the strands to substantial tensile forces which are directly proportional to the differential between the inflation pressure inside of the packer element and the well bore pressure outside of the element. These tension forces must be carried by the end-coupling assemblies 31 if the packer 10 is to continue functioning. Accordingly, as illustrated in FIG. 2, the outer ends of the inner and outer coupling members 32 and 35 are respectively shaped to provide external and internal tapered surfaces 39 and 40 to cooperatively define an outwardly-diverging annular socket 41 for receiving the exposed end portions of the several reinforcing plies 27–30 To secure the strands of the reinforcing plies 27–30 in the socket 41, the end-coupling assembly 31 of the present invention further includes wedge means such as inner and outer wedge-shaped gripping members 42 and 43 which are forcibly driven between the exposed ends of the reinforcing plies 27–30.

In the preferred embodiment of the coupling assembly 31, the wedge means are formed as unitary rings 42 and 43 which are made radially expansible by cutting each of the rings at circumferentially-spaced intervals with alternately-directed longitudinal slots of substantial length. As depicted, the inner gripping member 42 has a cylindrical outer surface and is formed with a tapered bore which is enlarged toward its inner end so as to be substantially parallel to the external facing surface 39 of the inner coupling member 32. Similarly, the outer gripping member 43 is formed with a cylindrical bore and has an outer tapered surface which is gradually reduced toward its inner end so as to be substantially parallel to the internal facing surface 40 of the outer coupling member 35. To enhance the holding force of the wedge-like gripping members 42 and 43, longitudinally-spaced rows of teeth, as at 44 and 45, are formed on the internal and external surfaces of the gripping members. By forcibly driving the gripping members 42 and 43 between the free ends of the strands of the reinforcing plies 27–30, the wedging action provided by the coaction of the tapered facing surfaces 39 and 40 on the coupling members 32 and 35 with the teeth, as at 44 and 45, will effectively clamp the ends of the reinforcing strands at each end of the inflatable packer element 22 against the facing surfaces of the end-coupling assemblies 31.

In one manner of securing the packer element 22 to the central mandrel 18 of the inflatable packer 10, each end-coupling assembly 31 further includes an annular end coupling member 46 which is threadedly secured at one end, as by threads 47, to the outer coupling member 35 and which is secured at its other end by conventional means of attachment to the mandrel 18. Each end-coupling assembly 31 also includes another annular end-coupling member 48 threadedly coupled, as by threads 49, to the inner coupling member 32 to firmly hold the end-coupling member against an outwardly-facing shoulder, as at 50, in each of the outer end-coupling members 46. This prevents relative movement of the coupling members 32 and 35, thereby keeping gripping members 42 and 43 firmly in position.

Figure 3:
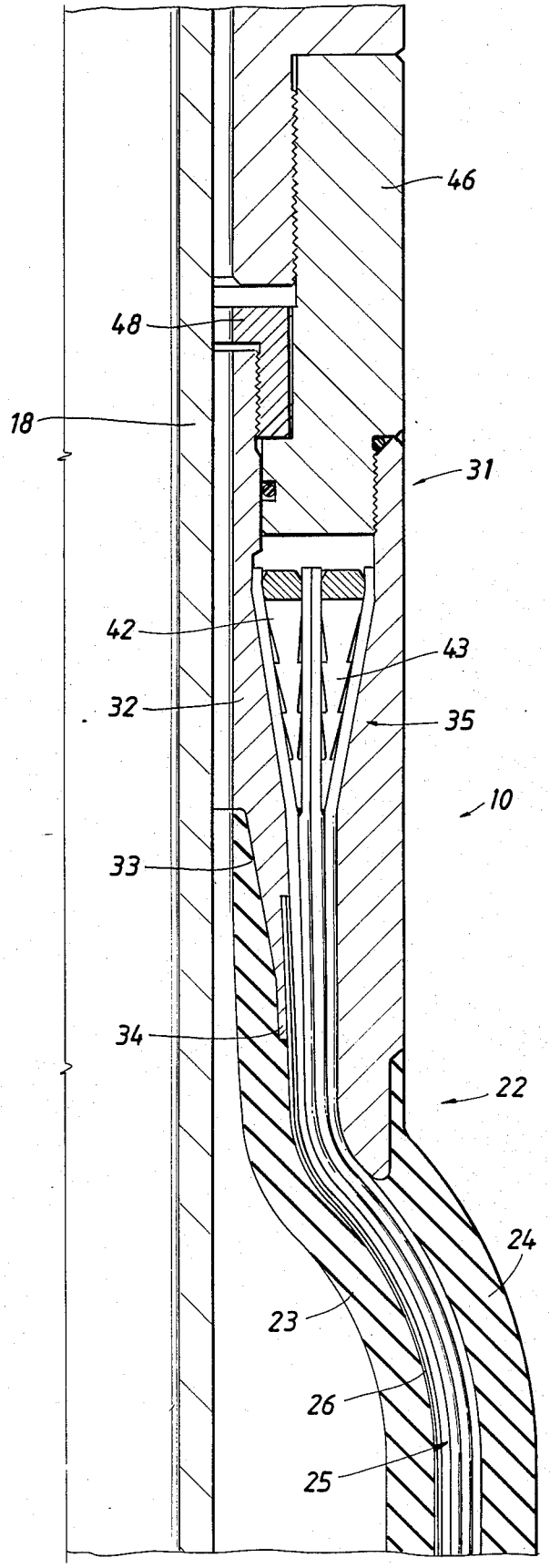
FIG. 3 depicts a portion of the coupling assembly shown in FIG. 2 as it will appear after it has been expanded by inflation of the packer element.

Turning now to FIG. 3, a partial view is shown of the new and improved well packer 10 to illustrate the cooperative action of the elements of the end-coupling assemblies 31 when the packer element 22 is inflated. Focusing on a significant aspect of the present invention, it is noted that the reduced or deformable portion 34 of the inner coupling member 32 will be flared or expanded outwardly by the internal pressure forces serving to inflate the packer element 22. Thus, the outward movement of the deformable skirt portion 34 on each coupling assembly 31 will effectively cover the annular gaps formed between the outer surface 39 of the inner coupling member 32 and the inner sheath 26 and inner reinforcing ply 27 of the reinforcing sleeve 25 when the reinforcing sleeve 25 is forced tightly against the inner facing surface 40 of the outer coupling member 35. These gaps are small; but the support cooperatively provided by the deformable skirt portions 34 at this critical location at each end of the packer element 22 will effectively reduce, if not preclude altogether, the unwanted extrusion of the inner elastomeric ply 23 through these gaps. Such unwanted extrusion into the sealed low pressure cavity of socket 41 has been a major cause of failure in prior art inflatable well bore packers.

It is also noted, with reference to FIG. 3, that the axial or longitudinal spacing between the inner end of the reduced portion 34 of the inner coupling member 32 and the rounded end 36 of the outer coupling member 35 is such that, upon inflation of the packer element 22, the reinforcing plies 27–30 are allowed to diverge outwardly in a gradual curve rather than having to sharply bend across an abrupt, unrounded corner. This feature prevents the cutting of the reinforcing strands 27–30 and the tearing of the outer elastomeric sleeve 24 that occurs during inflation of prior art packer elements, thereby avoiding fluid leak paths across the packer from the well annulus to the isolated interval through the wire paths of sleeve 25.

DESCRIPTION OF AN ALTERNATIVE EMBODIMENT

Figure 4:
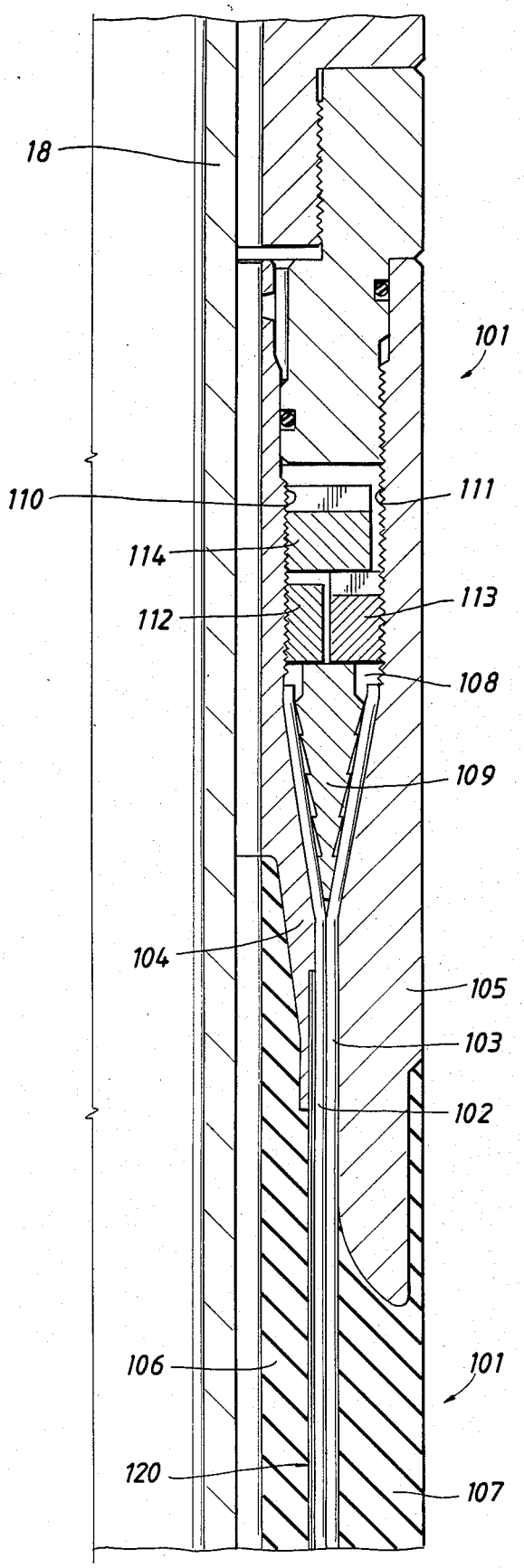
FIG. 4 is an enlarged cross-sectioned view similar to FIG. 2 but depicting an alternative embodiment of a new and improved coupling assembly also arranged in accordance with the principles of the present invention.

As an alternative to the end-coupling assemblies 31 shown in FIG. 2, a partial cross-sectional view is shown in FIG. 4 of a similar end-coupling assembly 100 incorporating the principles of the present invention. As illustrated, the new and improved end-coupling assembly 100 is cooperatively arranged for securing the ends of an inflatable packer element 101 which has only two plies of reinforcing strands 102 and 103 instead of the four plies of reinforcing strands employed in the packer element 22. By comparing FIGS. 2 and 4 it can be seen that the end-coupling assembly 101 is almost identical to the end-coupling assembly 31 in that the alternative assembly also employs inner and outer end-coupling members 104 and 105 which are respectively bonded to inner and outer elastomeric sleeves or plies 106 and 107; and that the adjacent surfaces of these end-coupling members are appropriately fashioned for defining therebetween an inwardly-tapered annular space 108 into which the free end portions of the reinforcing strands of plies 102 and 103 are extended and firmly secured by wedge means such as a single expansible wedge-like gripping member 109.

The particular distinction of the alternative coupling assembly 100 is that external and internal threads 110 and 111 are respectively arranged on the inner and outer coupling members 104 and 105 for receiving coaxially-fitting, inner and outer support rings 112 and 113. In installing these support rings 112 and 113, one support ring is initially installed and securely tightened to urge the wedge-like gripping member 109 firmly against one set of the reinforcing strands 102 and 103; then the other support ring is securely tightened so as to firmly secure the gripping member 109 against the other set of reinforcing strands. A lock ring 114 threaded to inner coupling member 104 can then be brought into locking engagement against outer ring 113, to prevent relative movement between the inner and outer coupling members 104 and 105.

The independent tightening action of rings 112 and 113 against member 109 is advantageous to accommodate structural mismatch. Though shown in FIG. 4 in a packer embodiment having only two plies 102 and 103, the same arrangement is beneficial to provide tight anchoring with a greater number of reinforcing plies.

In particular, it is noted that a support ring arrangement similar to that shown in FIG. 4 by rings 112 and 113 may be utilized for respectively securing the two gripping members 42 and 43 of the embodiment shown in FIGS. 2 and 3.

It will be appreciated by those skilled in the art to which the invention relates that broad application can also be given in many embodiments, other than those describe herein, to an inner coupling member, such as described member 32 or 104, having an outwardly deformable thin-walled skirt end portion to prevent extrusion of an inner elastomeric ply into a low pressure gap left during packer inflation as a reinforcing sleeve is forced away from the outer surface of the inner coupling member. Such an inner coupling member serves to reduce the risk of failure at a critical point in packer construction and can thereby contribute significantly to the ability of a inflatable packer to withstand large differential pressures. Reduction in risk of failure can also be broadly achieved by the use of an outer coupling member, such as described member 35 or 105, having a rounded outwardly-diverging tip 36 around which a reinforcing sleeve can expand during packer inflation, eliminating sharp edges or abrupt structure that might otherwise cut strands or tear elastomer to form annulus fluid leakage paths across the packer. It is with such other embodiments in mind, and in consideration of the various changes and modifications that may be made to the two embodiments described without departing from the invention in its broader aspects, that the claims are presented below.

What is claimed is:

1. An inflatable well packer comprising:

a cylindrical mandrel;

a packer element comprising substantially tubular inner and outer elastomeric plies coaxially mounted on said mandrel, a protective sheath surrounding said inner ply which sheath is capable of resisting the forced extrusion of the elastomeric material of said inner ply therethrough, and a reinforcing sleeve intermediate said protective sheath and said outer ply; and coupling assemblies cooperatively coupling respective ends of said reinforcing sleeve to said mandrel, each of said coupling assemblies including inner and outer ring members coaxially mounted on said mandrel with facing surfaces defining an annular space for receiving the adjacent ends of said reinforcing sleeve and wedge member means positioned in said annular space for securing ends of said reinforcing sleeve between said inner and outer ring members, said wedge member means including tooth means for firmly gripping said ends of the reinforcing sleeve thereby preventing said wedge member means from slipping out of said annular space and wherein said inner ring members have respective thin walled end portions which extend between the corresponding ends of said inner elastomeric ply and said protective sheath, said respective end portions being flexible so as to be subject to being deformed outwardly relative to said mandrel in response to inflation of said packer element.

2. The packer of claim 1 wherein said respective end portions include a recess in the outer surfaces thereof wherein the ends of said protective sheath are carried.

3. An inflatable well packer adapted to be positioned in a well bore and expanded into sealing engagement with the walls of the well bore comprising:

a cylindrical mandrel adapted for coupling to a pipe string;

an inflatable packer element coaxially mounted on said mandrel having a tubular inner elastomeric ply coaxially disposed within a shorter tubular outer elastomeric ply, a protective sheath surrounding said inner ply, said sheath restraining the elastomeric material of said inner ply when the packer element is inflated, and a reinforcing sleeve positioned between said sheath and said outer ply, said sleeve being formed of multiple biased layers of closely-spaced reinforcing strands cooperatively bonded together and to said outer elastomeric ply for defining a unitary element with the ends of said reinforcing strands projecting from the upper and lower ends of said inner and outer plies of said packer elements; and coupling assemblies cooperatively coupling said upper and lower ends of said packer element to said mandrel, each of said coupling assemblies comprising an inner and an outer ring coaxially arranged about the mandrel and a wedge member means, said inner ring having a thin walled end portion arranged to extend between the inner ply and said reinforcing sleeve, said inner and outer rings being provided with facing surfaces defining an annular space for receiving the adjacent ends of said reinforcing sleeve and of said protective sheath, said wedge member means being positioned in said annular space for securing ends of said reinforcing sleeve between said inner and outer ring member, and including tooth means for gripping said ends of said reinforcing sleeve firmly thereby preventing said wedge member means from slipping out of said annular space and wherein said thin walled end portions extend between the corresponding ends of said inner elastomeric ply and said protective sheath, said respective end portions being flexible so as to be subject to being deformed outwardly relative to said mandrel in response to inflation of said packer element.

4. The packer of claim 3 wherein each of said respective end portions include a recess in the outer surfaces thereof wherein the ends of said protective sheath are carried.

5. An inflatable well packer adapted to be positioned in a well bore and expanded into sealing engagement with the walls of the well bore comprising:

a cylindrical mandrel adapted for coupling to a pipe string;

an inflatable packer element coaxially mounted on said mandrel having a tubular inner elastomeric ply coaxially disposed within a tubular outer elastomeric ply, and an intermediate reinforcing sleeve formed of multiple biased layers of closely-spaced reinforcing strands cooperatively bonded together and to said outer elastomeric ply for defining a unitary element with the ends of said reinforcing strands projecting from the upper and lower ends of said inner and outer plies of said packer element; and coupling assemblies cooperatively coupling said upper and lower ends of said packer element to said mandrel, each of said coupling assemblies comprising an inner and an outer ring coaxially arranged about the mandrel and a wedge member means disposed therebetween, the inner ring having a thin-walled end portion arranged to extend over the inner ply, said wedge member means including two wedge member means arranged in a position between the inner and outer rings for securing ends of said reinforcing sleeve between said inner and outer ring members, each of the two wedge member means including tooth means for firmly gripping said ends of the reinforcing sleeve thereby preventing the two wedge member means from slipping out of said position between the inner and outer rings and wherein said thin walled end portions extend between the corresponding ends of said inner elastomeric ply and said intermediate reinforcing sleeve, said respective end portions being flexible so as to be subject to being deformed outwardly relative to said mandrel in response to inflation of said packer element.

6. The packer of claim 5, further comprising a protective sheath surrounding said inner ply, which sheath is capable of resisting the forced extrusion of the elastomeric material of said inner ply therethrough.

7. The packer of claim 6 wherein said respective end portions include a recess in the outer surfaces thereof within which the ends of said protective sheath are carried.

* * * * *